United States Patent [19]

Ivanov et al.

[11] 3,938,596

[45] *Feb. 17, 1976

[54] TURBO-DRILL

[76] Inventors: Evgeny Illarinovich Ivanov, 2 Setunsky proezd, 4, kv. 150, Moscow; Viktor Semenovich Olthow, ulitsa Karla Marksa, 30, kv. 8, Perm; Evgeny Dmitrievich Kostyrya, ulitsa Truda, 43, kv. 75, Perm; Nikolai Dmitrievich Derkach, ulitsa Stakhanova 40, kv. 66, Perm, all of U.S.S.R.

[ * ] Notice: The portion of the term of this patent subsequent to Aug. 28, 1990, has been disclaimed.

[22] Filed: May 14, 1974

[21] Appl. No.: 469,901

Related U.S. Application Data

[63] Continuation of Ser. No. 341,115, March 14, 1973, abandoned.

[30] Foreign Application Priority Data

Mar. 15, 1972 U.S.S.R. ..... 1759137

[52] U.S. Cl. ..... 173/73; 175/106; 175/107; 415/502

[51] Int. Cl.[2] ..... F01D 15/12

[58] Field of Search ..... 175/106, 107; 173/73; 415/502

[56] References Cited

UNITED STATES PATENTS

| | | | |
|---|---|---|---|
| 2,937,008 | 5/1960 | Whittle | 175/107 |
| 3,039,735 | 6/1962 | Tivaspolsky et al. | 175/107 |
| 3,598,187 | 8/1971 | Mothre | 173/73 |
| 3,754,835 | 8/1973 | Ivanov et al. | 415/502 |

*Primary Examiner*—Frank L. Abbott
*Assistant Examiner*—William F. Pate, III
*Attorney, Agent, or Firm*—Holman & Stern

[57] ABSTRACT

A turbo-drill is provided with a mechanism for reducing the speed of rotation of the drilling bit, the mechanism being made in the form of a frictional reduction means wherein the rotors of the turbo-drill are the inner wheel and the stators of the turbo-drill are the outer wheel. Between the stators and rotors in the carrier of the reduction means disposed are bodies of rolling, which roll during rotation of the rotor under the action of contact frictional forces. In addition, between the reduction stages of the turbine and above them mounted are one or more auxiliary stages of the turbine, each having two wheels provided with vanes, one of the wheels being connected through its hub to the shaft so as to enable axial displacement thereof with respect to the shaft.

2 Claims, 8 Drawing Figures

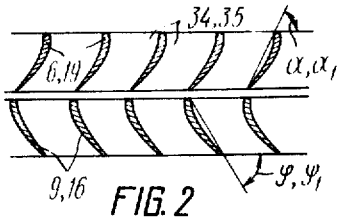
FIG. 2
FIG. 3
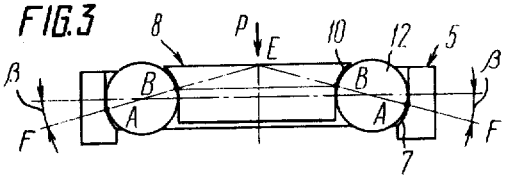
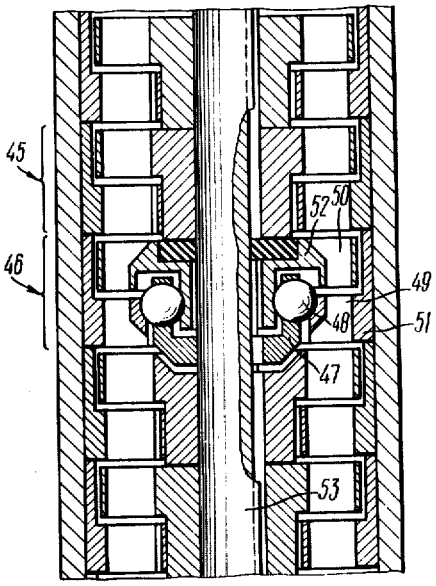
FIG. 6

TURBO-DRILL

This is a continuation, of application Ser. No 341,115, filed Mar. 14, 1973 now abandoned.

BACKGROUND OF THE INVENTION

The present invention relates generally to hydraulic bottomhole motors for drilling holes in the course of prospecting for or producing oil, gas and other minerals and, more particularly, it relates to turbo-drills.

There is known in the prior art a tubo-drill (cf. U.S. patent application No. 174,861 of Aug. 26, 1971; British patent application No. 41,192 of Sept. 3, 1971) for drilling holes, comprising: a housing having stators secured therein and provided with races and vanes forming guiding channels for passing therethrough a flushing fluid; rotors provided with races and vanes directed oppositely with respect to the stator vanes, whereby the flow of the flushing fluid through the turbo-drill rotates the rotor in relation to the stator; a shaft having a plurality of rotors and disposed in the housing on supports; a supporting unit transmitting force from a string of drill pipes to a drilling bit; bodies of rolling disposed in carriers connected to the shaft, and located between the races of the stators and rotors so as to form together with the carriers, stators and rotors reduction stages forming an axial reduction tubine wherein between the rotors which are an inner driving wheel of the reduction turbine and the stators which are an outer wheel of the tubine, are disposed bodies of rolling which during rotation of the rotors will roll under the action of contact frictional forces and, since the diameter of the race of the inner driving wheel of the reduction turbine is smaller than that of the outer wheel of the turbine, the speed of rotation of the drilling bit is reduced in relation to the speed of rotation of the rotor.

The races of the rotors are disposed in their operative position higher than the respective races of the stators, whereby the bodies of rolling acted upon by a downwardly directed axial force developing on the rotors in the course of translatory motion of the flushing fluid through the reduction stages of the turbine are pressed against the races of the stators and rotors, thereby developing contact frictional forces transmitting the torque to the drilling bit.

During operation of the said turbo-drill which is provided with a turbine having a low pressure differential on the vanes of the rotors and stators, there may occur slippage of the bodies of rolling, which disadvantage reduces reliability of operation of the reduction turbine and efficiency of the turbo-drill.

SUMMARY OF THE INVENTION

An object of the present invention is to provide a turbo-drill which is more reliable in operation.

Another object of the present invention is to provide a turbo-drill having a higher efficiency at such speeds of rotation of the drilling bit, that are specific for rotary drilling.

These and other objects are attained, according to the present invention, in a turbo-drill for drilling holes, connected with its upper portion to the lower end of a string of drill pipes and with its lower portion, through one of its elements, to a drilling bit, comprising a housing having secured therein a plurality of stators provided with races and vanes forming together a plurality of guiding channels for passing therethrough a flushing fluid; a plurality of rotors provided with races and vanes directed oppositely to the direction of the vanes of stators, thereby rotating the rotor in relation to the stator when the flushing fluid passes through the turbo-drill: a shaft having the rotors mounted thereon and adapted to rotate with respect thereto, the shaft being mounted in the housing on a plurality of supports; a supporting unit transmitting the force from the string of drill pipes to the drilling bit; a plurality of bodies of rolling disposed in carriers connected to the shaft, the bodies of rolling being so located between the races of the stators and rotors as to form together with the carriers, stators and rotors a plurality of reduction stages of an axial reduction turbine wherein between the rotors, which are an inner driving wheel of the reduction turbine, and the stators, which are an outer wheel of the reduction turbine, are disposed the bodies of rolling which during rotation of the rotor will roll under the action of contact frictional forces and, since the diameter of race of the inner driving wheel of the reduction turbine is smaller than that of the race of the outer wheel of the reduction turbine, the speed of rotation of the element to which the drilling bit is secured is reduced with respect to the speed of rotation of the rotor, the races of the rotors being disposed in their operative position higher than the respective races of the stators, whereby the bodies of rolling acted upon by a downwardly directed axial force appearing on the rotors in the course of progressive motion of the flushing fluid through the reduction stages of the turbine are pressed against the races of the stators and rotors, thereby developing contact frictional forces between the bodies of rolling and the races of the stators and rotors, the forces transmitting the torque to the drilling bit. According to the invention, one or more auxiliary stages of the axial hydraulic turbine are mounted between the reduction stages of the turbine and above them, each of the auxiliary stages consisting of two wheels provided with vanes and hubs, one of the wheels being secured in the housing, while the other wheel being connected to the shaft and adapted to be axially displaced with respect thereto, the vanes of one wheel of each auxiliary stage of the axial turbine being directed oppositely to the direction of the vanes of the other wheel of each auxiliary stage of the axial turbine, thereby transforming the translatory motion of the flushing fluid into rotational motion of the wheels, thus enabling the wheels connected to the shaft to rotate in relation to the wheels secured in the housing, and vice versa. The wheels of each auxiliary stage of the axial hydraulic turbine, connected to the shaft, under the action of a downwardly directed axial force appearing on the vanes of the wheels in the course of translatory motion of the flushing fluid are pressed with the lower ends of their hubs against the upper ends of the rotors of the disposed below reduction stages, thereby increasing the pressure of the bodies of rolling against the races of the stators and rotors of the turbine reduction stages.

Such engineering solution makes it possible to improve the reliability of the turbo-drill operation and its efficiency at such speeds of rotation of the drilling bit, which are specific for rotary drilling.

It is expedient to mount rings of an elastic material between the rotors of the reduction stages and the wheels, connected to the shaft, of the auxiliary stages of the turbine, to reduce wear on the rotors of the reduction stages and the wheels connected to the shaft.

BRIEF DESCRIPTION OF THE DRAWINGS

The invention will be further explained by means of exemplary embodiments thereof taken in conjunction with the accompanying drawings, wherein:

FIG. 2 shows a cylindrically developed sectional view of the vanes of the stator and rotor of a reduction stage and of the vanes of the wheels of the turbine auxiliary stages;

FIG. 3 is a location diagram of the bodies of rolling and the races of the stators and rotors in the reduction stages;

FIG. 6 is a longitudinal sectional view of the reduction stages, in which the carriers with the bodies or rolling are disposed between the vanes of the stator and rotor and the shaft, and the auxiliary stages of the turbine disposed therebetween;

DETAILED DESCRIPTION OF THE PREFERRED EMBODIMENT

Figure 1:
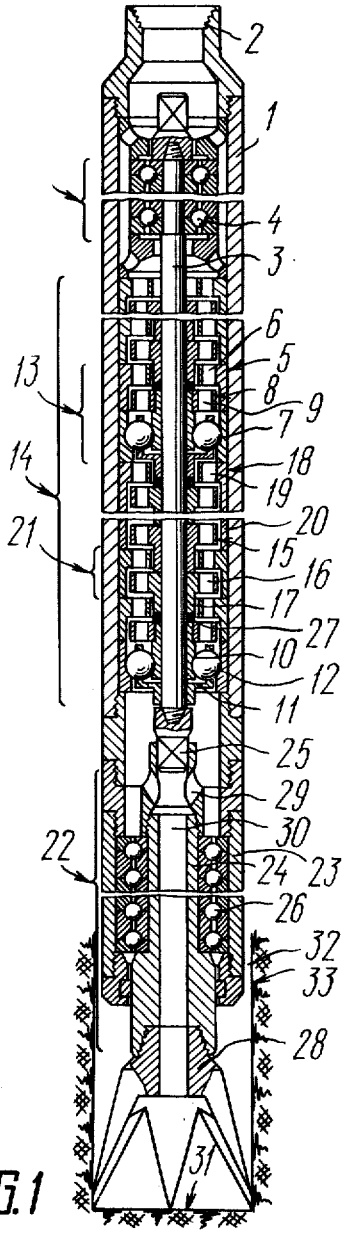
FIG. 1 illustrates a longitudinal section of a turbo-drill according to the invention, connected with the upper portion of its housing to the lower end of the string of drill pipes.

Referring now to the FIGS., FIG. 1 represents an embodiment of a turbo-drill according to the present invention. The tubo-drill comprises: a housing 1 of the turbine, connected with its upper portion having a thread 2 to the non-rotating string of drill pipes; a shaft 3 axially mounted in the housing 1 on bearings 4 to enable rotation of the shaft 3 with respect to the housing 1; stators 5 secured in the housing 1 and provided with vanes 6 and races 7; rotors 8 provided with vanes 9 and races 10 and mounted onto the shaft 3 so as to enable rotation and axial displacement of the rotors in relation to the shaft; carriers 11 having mounted therein balls 12, disposed between the races 7 and 10 of the stators 5 and rotors 8 so that the races 10 of the rotors 8 located above the races 7 of the stators 5, rest upon the races 7 of the stators by means of the balls 12.

The rotors 8 together with the carriers 11, balls 12 and stators 5 form reduction stages 13 of a turbine 14.

Between the rotors 8 of the reduction stages 13, mounted onto the shaft 3 are rotors 15 of the turbine wheel, provided with vanes 16 and hubs 17. The rotors 15 are mounted onto the shaft 3 so as to enable axial displacement thereof with respect to the shaft 3. Between the stators 5 of the reduction stages 13 in the housing 1 are mounted and secured stators 18 of the turbine wheel, provided with vanes 19 and hubs 20.

The rotor 15 having the vanes 16 and the hub 17 together with the stator 18 having the vanes 19 and the hub 20 form an auxiliary stage 21 of the turbine 14.

To the lower end of the housing 1 of the turbine 14 attached is a supporting unit 22 including a housing 23 removably connected to the housing 1 of the turbine 14, a shaft 24 connected with its upper end to the shaft 3 of the turbine 14 through a coupling 25 transmitting the torque to the shaft 24, and supports 26.

Between the upper ends of the rotors 8 of the reduction stages 13 and the lower ends of the hubs 17 of the rotors 15 of the auxiliary stages 21 of the turbine 14, mounted onto the shaft 3 are rings 27 of an elastic material, which reduce wear on the rotors 8 and the hubs 17.

A drilling bit 28 is attached to the lower end of the shaft 24 of the supporting unit 22.

The activating medium of the turbine 14 is a flushing fluid pumped from the surface into the turbo-drill through the string of drill pipes, the flushing fluid passing along the entire length of the turbo-drill from top to bottom, sequentially through all the stages of the turbine 14, both reduction stages 13 and auxiliary stages 21, and further through ports 29 in the coupling 25, a channel 30 in the shaft 24 of the supporting unit and channels in the drilling bit 28 to the hole bottom 31 and then through an annular space 32 between a wall 33 of the hole and the turbo-drill it flows upwards.

The vanes 6 (FIG. 2) of the stator 5 of the reduction stage are inclined to the plane normal to the turbo-drill axis and form guiding channels 34. The vanes 9 of the rotor 8 of the reduction stage are inclined oppositely to the inclination of the vanes 6 of the stators 5, thereby they change the direction of the fluid flow when it passes through the reduction stage, providing rotation of the rotors in relation to the stators.

The setting of the vanes 19 (FIG. 2), forming guiding channels 35, of the turbine wheel stator 18 and that of the vanes 16 of the tubine wheel rotor 15 of the auxiliary stage 21, as well as the mechanism for transforming kinematic energy of the flushing fluid into rotational motion of the rotors, are similar to that described for the stators 5 and the rotors 8 of the reduction stage 13.

The races 10 (FIG. 3) of the rotors 8 of the reduction stages 13 are disposed in their operative position higher than the respective races 7 of the stators 5 of the reduction stages 13. Since the diameter BB (FIG. 3) of the contact circumference of the race 10 and the balls 12 is smaller than the diameter AA of the contact circumference of the race 7 and the balls 12, the lines EF passing through the points A, B and the centers of the balls form $\epsilon$ contact angle $\beta$, with the plane normal to the turbo-drill axis, passing through the centers of the balls 12, whereby under the action of a downwardly directed axial force P, appearing on the said rotors 8 in the course of translatory motion of the flushing fluid through the reduction stages 13, generated are forces which press the bodies of rolling against the races of the rotors and stators, thereby developing contact frictional forces.

During rotation of the rotors 8, the balls 12 acted upon by the contact frictional forces roll between races 10 of the rotating rotors 8 and the races 7 of non-rotating stators 5, performing planetary motion about the axis of rotation of the rotors, and rotate the carriers 11 and shaft 3 of the turbine connected to them. Since the diameter BB (FIG. 3) of the contact circumference of the balls 12 and the race 10 is smaller than the diameter AA of the contact circumference of the balls 12 and the race 7, the speed of rotation of the drilling bit 28 connected through the shafts 3, 24 and the coupling 25 to the carriers 11 is reduced in relation to the speed of rotation of the rotors 8.

Figure 4:
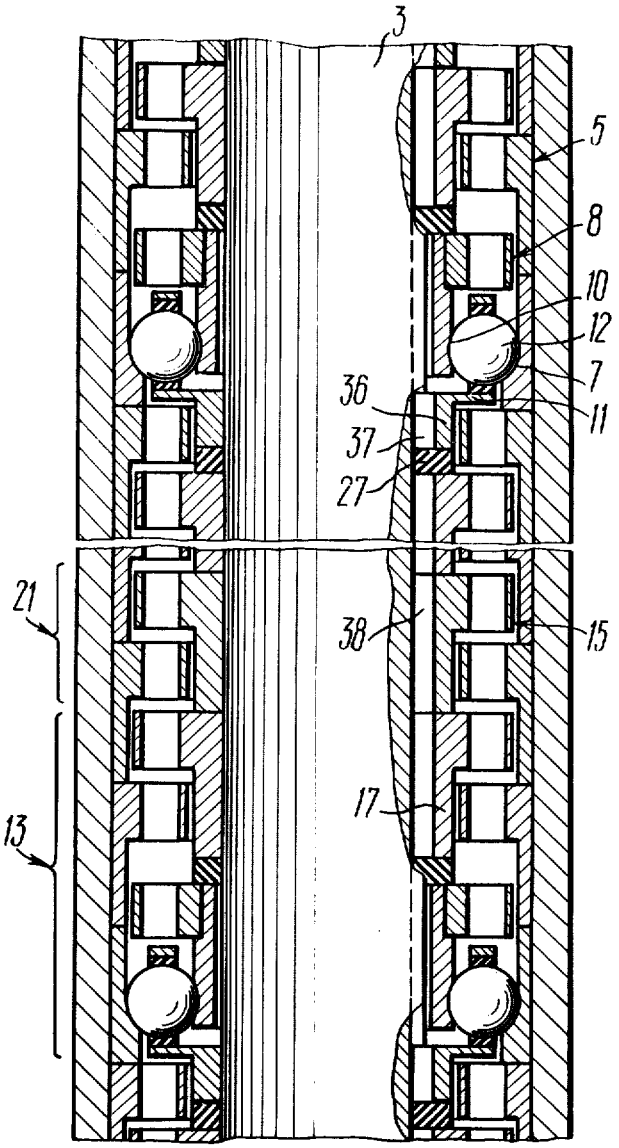
FIG. 4 depicts a longitudinal sectional view of the reduction stages, in which the carriers with the bodies of rolling are disposed below the vanes of the rotor, and the auxiliary stages of the turbine disposed therebetween.

The carriers (FIG. 4) 11 are provided with hubs 36 to transmit the torque to the shaft 3, which are connected to the shaft through keys 37 permitting axial displacement of the hubs 36 with respect to the shaft 3, and vice versa.

In order to transmit the torque to the shaft 3, the rotors 15 are also connected to the shaft 3 through keys 38 permitting axial displacement of the rotors 15 with respect to the shaft 3, and vice versa; the hubs 17 of the rotors 15, acted upon by a downwardly directed force appearing on the rotor vanes in the course of progressive motion of the flushing fluid through the auxiliary stages 21 of the turbine 4, being pressed against the hubs 17 of the rotors 15 disposed below, and each lower rotor 15 is pressed with the lower end of the hub 17 through the ring 27 against the upper end of the rotor 8 of the reduction stage, thereby increasing the pressing of the balls 12 to the races 7 and 10 of the stators 5 and rotors 8 of the reduction stages 13.

On the ground of the concept of the above turbo-drill proposed are the other embodiments thereof also having the reduction and auxiliary stages of the turbine, which are depicted in FIGS. 5 to 8.

Figure 5:
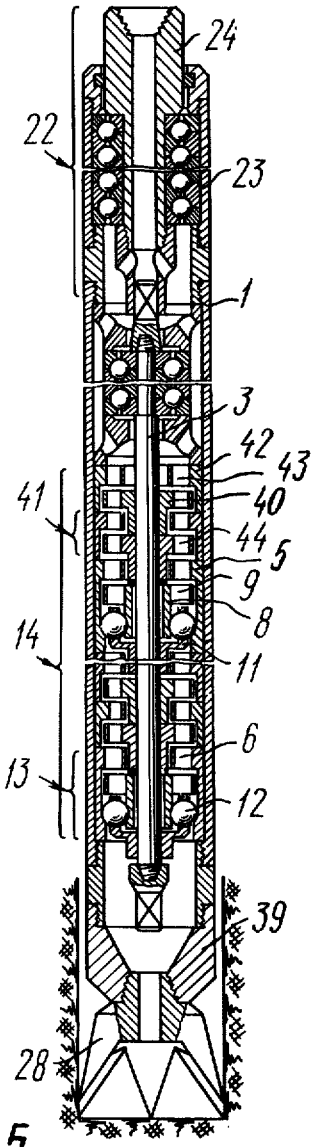
FIG. 5 depicts a longitudinal sectional view or the turbo-drill according to the invention, connected with the upper end of the shaft to the lower end of the string of drill pipes through the supporting unit.

One of these embodiments of the turbo-drill of this invention is shown in FIG. 5. In this structure, as distinct from the turbo-drill of FIG. 1, the housing 23 of the supporting unit 22 is connected to the upper end of the housing 1 of the turbine 14, while the shaft 24 of the supporting unit 22 is connected to the non-rotating string of drill pipes. In this case, the drilling bit 28 is connected through an adapter 39 to the lower end of the housing 1 of the turbine 14. In such embodiment of the turbo-drill, the shaft 3 and the carriers 11 of the reduction stages 13 connected thereto together with turbine wheel stators 40 of auxiliary stages 41, do not rotate, while the stators 5 of the reduction stages 13 and turbine wheel rotors 42 of the auxiliary stages 41 together with connected thereto the housing 1 with the adapter 39 and the drilling bit 28 rotate. During operation of the turbo-drill of this embodiment, the rotors 8, which are an inner driving wheel of the reduction gear, rotate in one direction, while the turbine wheel rotors 42 acted upon by the translatory motion of the flushing fluid through the auxiliary stages 41 and the stators 5, which are an outer wheel of the reduction gear, under the action of reactive forces developed by the translatory motion of the flushing fluid through the reduction stages 13, and of the torque transmitted from the rotating rotors 8 through the balls 12 disposed in the non-rotating carriers rotate in the opposite direction with respect to the direction of rotation of the rotors 8. In order to obtain normal (right-hand) rotation of the drilling bit 28, the vanes 6 of the stator 5 and vanes 43 of the rotor 42 are inclined in the same manner as the vanes 9 (FIG. 2) of the rotors 8 and the vanes 16 of the rotors 15, while the vanes 9 (FIG. 5) of the rotor 8 and vanes 44 of the stator 40 are inclined as the vanes 6 (FIG. 2) of the stator 5 and the vanes 19 of the stator 18. The other parts and components of the turbo-drill depicted in FIG. 5 are identical to those of the turbo-drill shown in FIG. 4.

In the course of operation of the turbo-drill of FIG. 5, a portion of power obtained on the turbine 14 is transmitted to the drilling bit 28 through the housing 1 and the adapter 39 from the rotating rotors 42 of the auxiliary stages and the stators 5 of the reduction stages, while the rest of the power is transmitted to the drilling bit through the balls 12 disposed in the non-rotating carriers from the rotating rotors 8 of the reduction stages 13.

FIG. 6 depicts another embodiment of the turbo-drill according to the invention, wherein auxiliary stages 45 are disposed between reduction stages 46 in which carriers 47 with balls 48 are located between vanes 49 and 50 of stators 51 and rotors 52, respectively, from one side, and a shaft 53, from the other side.

Figure 7:
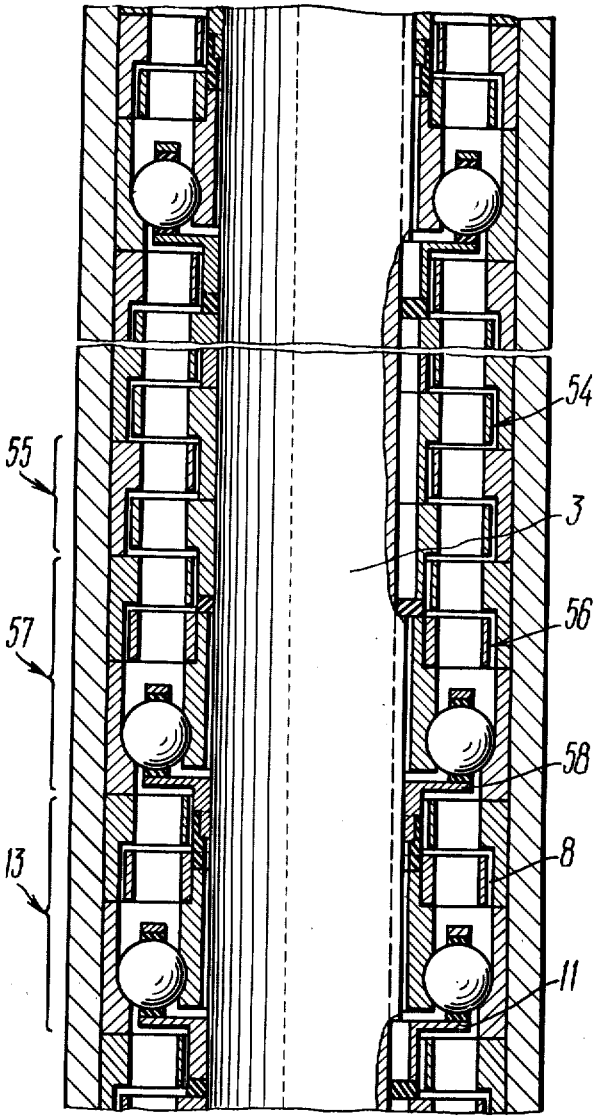
FIG. 7 is a longitudinal sectional view showing the positioning of the wheels of the turbine auxiliary stages between the turbine reduction stages in a multi-stage reduction arrangement.
Figure 8:
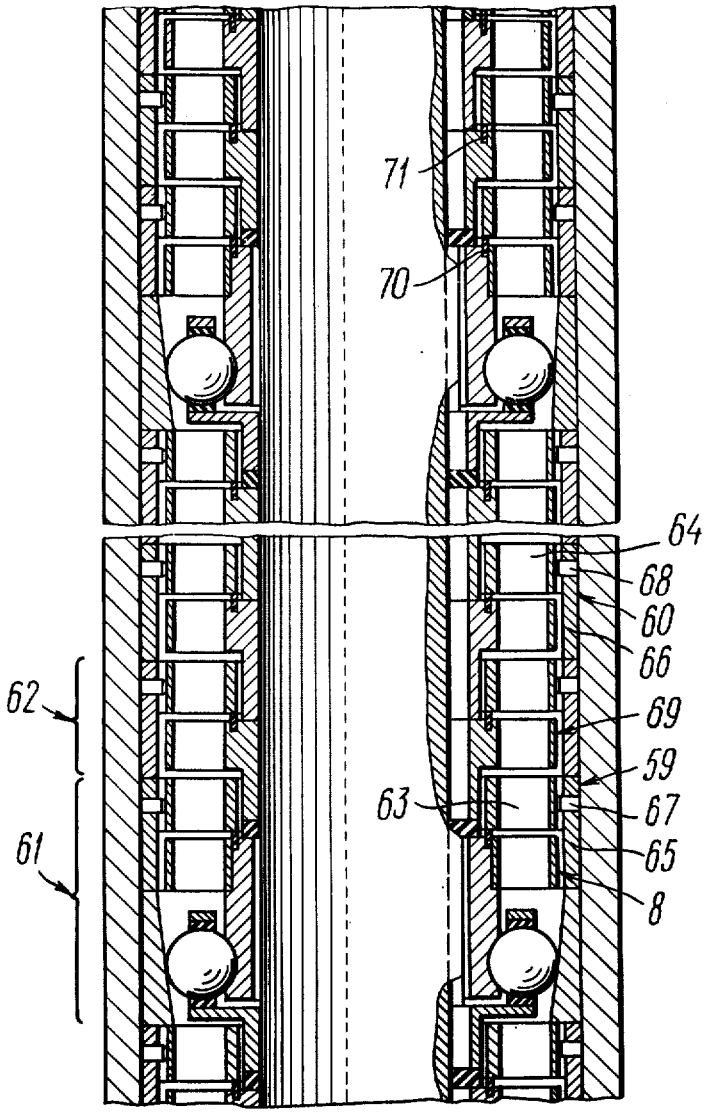
FIG. 8 depicts a portion of the turbo-drill of the invention, wherein the stators of the reduction and auxiliary stages of the turbine are mounted axially movable with respect to the housing.

In FIG. 7 shown is yet another embodiment of the turbo-drill of the invention, wherein rotors 54 of auxiliary stages 55 are pressed against a rotor 56 of a reduction stage 57 in which a carrier 58, in order to increase the gear ratio of reduction, is connected to the rotor 8 of the disposed below reduction stage 13, whose carrier 11 is connected to the shaft 3.

The wear on balls can be reduced first of all by preventing the slippage thereof along the races. In particular, this may be achieved by increasing the force pressing the balls against the races. One of the methods of increasing this force consists in transmitting to the rotor the hydraulic force developed during operation on stators 59 and 60 (FIG. 8) of reduction 61 and auxiliary 62 stages, respectively. For this purpose the stators 59 and 60 are made sectional. Vanes 63 and 64 are made separately from their respective hubs 65 and 66 and connected to them by the respective keys 67 and 68; under the action of progressive motion of the flushing fluid they are pressed against the upper ends of the rotors 8 and 69 through elastic elements 70 and 71 mounted on the ends of the rotors 8 and 69, respectively.

The hereinabove disclosed engineering solutions allow a simple and compact structure of the turbo-drill having high reliability and efficiency.

The turbo-drills designed in accordance with this invention in 7½ inches gauge are successfully used for drilling in diverse geological conditions.

Over all the regions of application of the turbo-drills of the present invention, having the reduction and auxiliary stages of the turbine, the overhaul period of the turbo-drill has increased more than twice as compared to that of the turbo-drills provided with the reduction stages of the turbine only (without the auxiliary stages). Also the footage drilled per drilling bit has been increased.

What we claim is:

1. A turbo-drill comprising: a housing including means at its upper end for connection to the lower end of a string of drill pipes; a shaft disposed in said housing on supports including means for mounting a drill bit; a supporting unit to transmit the force to the drilling bit from said string of drill pipes, said supporting unit being arranged under said housing with said shaft arranged therein and connecting the shaft to the drilling bit; stators secured in said housing and provided with races and vanes forming guiding channels for passing therethrough a flushing fluid pumped from the surface through said string of drill pipes to activate said turbo-drill, said flushing fluid flowing throughout the entire lenght of said turbo-drill and through said drilling bit to a hole bottom being drilled, and the fluid returning upward through a space around the pipes; rotors mounted on said shaft for relative rotation with respect to said shaft, said rotors having races and vanes facing in a direction opposite to that of said vanes of the stators for transforming the translational motion of said flushing fluid into rotational motion of said rotors; carriers with rolling bodies disposed therein which are located between said races of said stators and rotors and connected to said shaft, said rolling bodies being disposed between said races of the stators and rotors and forming, together with said carriers, stators and rotors, reduction stages of an axial reduction turbine wherein said rotors form a driving inner wheel, said stators forming an outer wheel, and said rolling bodies forming idlers, said races of the rotors being located in an operative position above the respective races of the stators, as a result of which downward axial force developing on said rotors during the translational motion of the flushing fluid through said reduction stages presses said rolling bodies against said races of the stators and rotors so that contact friction forces are generated between said rolling bodies and said races of the stators and rotors and transmit torque through the idler elements to the drilling bit, the stator vanes forming channels for the passage of flushing fluid, and the rotors having vanes face in a direction opposite to that of said vanes of the stators, forming reductionless stages of the turbine and are mounted between and above said reduction stages so that the stators are fixedly positioned in said housing, and the rotors are mounted on the shaft and adapted to move axially so as to be pressed with their lower end faces, under the effect of the downward axial force generated during the translational motion of the flushing fluid on the vanes of said rotors of the reductionless stages of the turbine to the upper end faces of the rotors of the underlying reduction stages, thereby increasing the force with which said rolling bodies are pressed against said races of the stators and rotors of the reduction stages.

2. A turbo-drill as claimed in claim 1, wherein between the upper end faces of said rotors of the reduction stages of the turbine and the lower end faces of the common reductionless stages of the turbine there are located rings of elastic material for reducing the wear on the end faces of the rotors in the reduction and reductionless stages of the turbine.

* * * * *